US006906692B2

(12) United States Patent
Ishiyama

(10) Patent No.: US 6,906,692 B2
(45) Date of Patent: Jun. 14, 2005

(54) LIQUID CRYSTAL DEVICE, LIQUID CRYSTAL DRIVING DEVICE AND METHOD OF DRIVING THE SAME AND ELECTRONIC EQUIPMENT

(75) Inventor: Hisanobu Ishiyama, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 75 days.

(21) Appl. No.: 09/818,263

(22) Filed: Mar. 26, 2001

(65) Prior Publication Data

US 2002/0044113 A1 Apr. 18, 2002

(30) Foreign Application Priority Data

Mar. 28, 2000 (JP) ..... 2000-089321

(51) Int. Cl.[7] ..... G09G 3/36
(52) U.S. Cl. ..... 345/96; 345/92; 345/209
(58) Field of Search ..... 345/87–104, 204, 345/208–210, 690–693

(56) References Cited

U.S. PATENT DOCUMENTS 4,393,380 A * 7/1983 Hosokawa et al. ..... 340/805
5,430,460 A * 7/1995 Takabatake et al. ..... 345/96
5,774,099 A * 6/1998 Iwasaki et al. ..... 345/92
5,923,310 A * 7/1999 Kim ..... 345/90

FOREIGN PATENT DOCUMENTS

| | | | |
|---|---|---|---|
| EP | 0-558059 | 9/1993 | |
| JP | 55-120095 | 9/1980 | |
| JP | 63-005324 | 1/1988 | |
| JP | 02-312466 | 12/1990 | |
| JP | 05-341730 | 12/1993 | |
| JP | 6-222330 | * 8/1994 | ..... 345/103 |
| JP | 08-248929 | 9/1996 | |
| JP | 08-320673 | 12/1996 | |
| JP | 11-044891 | 2/1999 | |

* cited by examiner

*Primary Examiner*—Lun-yi Lao
(74) *Attorney, Agent, or Firm*—Hogan & Hartson, LLP

(57) ABSTRACT

A liquid crystal panel (10) has a scanning line (Y) and a data line (X), a TFT (30) connected to the scanning line (Y) and the data line (X), a pixel electrode (32) connected to the TFT (30), and a rectangular opposite electrode (C) arranged oppositely to the pixel electrode (32) through a liquid crystal layer. The liquid crystal panel (10) is driven by a scanning line driving circuit (20) which supplies a scanning signal including a scanning period selecting at least one scanning line (Y), a data line driving circuit (22) which supplies a data signal to the data line (X), and an opposite electrode driving circuit (24) which changes a voltage supplied to the opposite electrode (C) corresponding to the selected scanning line in synchronization with the scanning period, and inverts the polarity of a voltage applied to the liquid crystal layer.

14 Claims, 12 Drawing Sheets

FIG. 10A
PRIOR ART
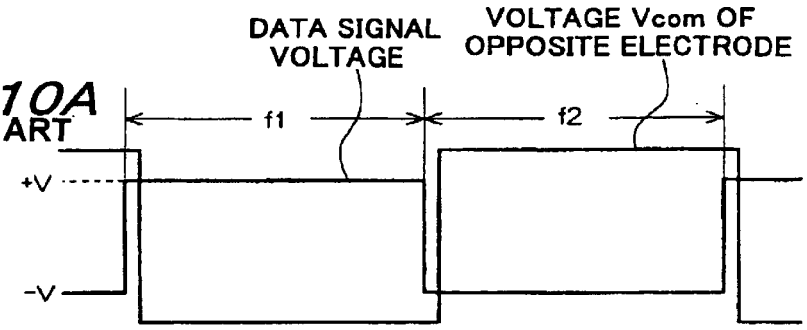
FIG. 10B
PRIOR ART
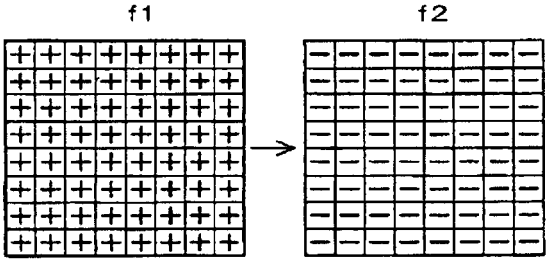
FIG. 10C
PRIOR ART
| | f1 | | | | | f2 | | | | |
|---|---|---|---|---|---|---|---|---|---|---|
| SELECTED PERIOD | H1 | H2 | H3 | ··· | H240 | H1 | H2 | H3 | ··· | H240 |
| SCANNING LINE 1 | | | +5V | | | | | -5V | | |
| SCANNING LINE 2 | -4.9V | | +5V | | | +4.9V | | -5V | | |
| SCANNING LINE 3 | -4.9V | | | +5V | | +4.9V | | | -5V | |
| ⋮ | | | ⋮ | | | | | ⋮ | | |
| SCANNING LINE 240 | | -4.9V | | | +5V | | +4.9V | | | -5V |

LIQUID CRYSTAL DEVICE, LIQUID CRYSTAL DRIVING DEVICE AND METHOD OF DRIVING THE SAME AND ELECTRONIC EQUIPMENT

BACKGROUND OF THE INVENTION

1. Field of the Invention

The present invention relates to a liquid crystal device, liquid crystal driving device and method of driving the same, and electronic equipment.

2. Description of the Related Art

Alternating voltage driving such as polarity inversion driving every frame (hereinafter, briefly described as frame inversion driving), polarity inversion driving every line (hereinafter, briefly described as line inversion driving), and polarity inversion driving every dot (hereinafter, briefly described as dot inversion driving) is known at present as a driving system of an active matrix type liquid crystal device, particularly, a TFT type liquid crystal device. Further, in such driving systems, a driving system (hereinafter, briefly described as an opposite electrode inversion driving system) for applying the voltage of polarity reverse to that of a voltage applied to a pixel electrode to an opposite electrode is simultaneously adopted to reduce power consumption. In the following description, respective operations of the frame inversion driving and the line inversion driving using the opposite electrode inversion driving system will next be explained.

FIGS. 10A to 10C are views for explaining a conventional operation of the frame inversion driving. In the frame inversion driving, the voltage polarity of a data signal supplied to a data line is inverted every one frame period as shown in FIG. 10A. The voltage supplied to the data line is set to positive polarity +V in a frame period $f_1$, and is set to negative polarity −V in a frame period $f_2$. A voltage Vcom of the opposite electrode applied to the opposite electrode is also inverted every one frame period in synchronization with this voltage supplied to the data line. The voltage difference between the voltage V of this data signal and the voltage Vcom of the opposite electrode is applied to a liquid crystal. This is visually shown in FIG. 10B.

FIG. 10C shows a change in voltage applied to each pixel of a liquid crystal panel having e.g., 240 scanning lines with the passage of time. Selected periods for sequentially selecting the 240 scanning lines one by one are respectively defined as $H_1$ to $H_{240}$. Here, for convenience, ±5 V is uniformly applied to the liquid crystal as an example. The data signal of the positive polarity is applied in the frame period $f_1$. When a scanning line 1 is selected in a selected period $H_1$, the voltage of +5 V is applied to a pixel corresponding to the selected scanning line 1. When a scanning line 2 is selected in a selected period $H_2$, the voltage of +5 V is similarly applied to a pixel corresponding to the selected scanning line 2.

At this time, as shown in FIG. 10A, the voltage Vcom of the opposite electrode is changed in synchronization with the beginning of the selected period $H_1$ of the frame period $f_1$. Therefore, a voltage caused by parasitic capacity, etc. is applied to the liquid crystal of pixels corresponding to scanning lines 2 to 240 during the selected period $H_1$ in which the scanning line 1 is selected in the frame period $f_1$.

As shown in FIG. 12, this parasitic capacity is a capacity $C_{GD}$ generated between a gate G and a drain D of a thin film transistor (TFT) 30, and a capacity $C_{DS}$ generated between the drain D and a source S. It is further considered that there is also an influence of wiring capacity floated in wiring.

In FIG. 10C, a voltage change caused by the parasitic capacity, etc. is set to ±0.1 V as one example. Accordingly, a voltage of +0.1 V caused by the parasitic capacity is added to −5 V as a voltage originally applied to the liquid crystal of a pixel corresponding to the scanning line 2 during the selected period $H_1$ so that the voltage actually applied to this liquid crystal becomes −4.9 V. Similarly, a parasitic capacity value +0.1 V is added to −5 V as a voltage originally applied to the liquid crystal during the selected period $H_2$ on a scanning line 3 selected in a selected period $H_3$ so that the voltage actually applied to the liquid crystal becomes −4.9 V. Similarly, the voltage applied to the liquid crystal is changed by the parasitic capacity on each of scanning lines 4 to 240. At this time, the interval of a period for applying the voltage changed by the parasitic capacity to the liquid crystal is different every scanning line as shown in FIG. 10C, and this difference causes flicker, display irregularities due to luminance inclination in a vertical direction, etc.

FIGS. 11A to 11C are views for explaining an operation of the line inversion driving. In the line inversion driving, as shown in FIG. 11A, the voltage polarity of the data signal supplied to the data line is inverted every selected period for selecting each scanning line, and every one frame period. In FIG. 11A, a positive polarity voltage +V or a negative polarity voltage −V is applied to the pixel electrode every selected period. The voltage Vcom applied to the opposite electrode is also inverted in synchronization with this voltage applied to the pixel electrode. FIG. 11B visually shows a change in voltage applied to the liquid crystal every selected period for selecting the scanning line, and every one frame period.

FIG. 11C shows an operation in which the voltage polarity on an adjacent scanning line is further inverted in the frame inversion driving of FIG. 10C. A data signal voltage of +5 V is applied to the data line in the selected period $H_1$ of the frame period $f_1$ on the scanning line 1. A data signal voltage of −5 V is applied to the data line during the selected period $H_2$ on the scanning line 2 selected in the selected period $H_2$. In this case, polarity of the opposite electrode is inverted in the selected period $H_2$ of the scanning line 1. Thus, a voltage of −0.1 V accumulated within the TFT 30 and wiring and caused by the parasitic capacity is added to a pixel so that the voltage becomes ±4.9 V. Similarly, a voltage of ±0.1 V caused by the parasitic capacity is also added to +5 V or −5 V as a voltage originally applied to the liquid crystal on respective scanning lines 3 to 240. The voltage applied to the liquid crystal is changed by this voltage caused by the parasitic capacity. However, a period of this change becomes one line period and is not easily recognized as flicker so that image quality is improved in comparison with the frame inversion driving system. Further, the voltage polarity of the opposite electrode must be changed every selected period in the line inversion driving system. Therefore, it is necessary to synchronize timing for inverting the polarity of the opposite electrode with each selected period so that power consumption is increased in comparison with the frame inversion driving system.

SUMMARY OF THE INVENTION

A liquid crystal device in one aspect of the present invention comprises:

M (M is an integer equal to or greater than 2) rows of scanning lines, and N (N is an integer equal to or greater than 2) columns of data lines;

M×N number of switching element respectively connected to one of the M rows of scanning lines and one of the N columns of data lines;

M×N number of pixel electrodes respectively connected to one of the M×N number of switching element;

M rows of opposite electrodes arranged oppositely to respective rows of the M×N number of pixel electrodes through a liquid crystal layer;

scanning line driving circuit which supplies a scanning signal including a scanning period for selecting at least one of the M rows of scanning lines to the M rows of scanning lines;

data line driving circuit which supplies a data signal to the N columns of data lines; and polarity inverting circuit which inverts a polarity of a voltage applied to the liquid crystal layer by changing a voltage supplied to an opposite electrode of a row corresponding to the selected scanning line in synchronization with the scanning period.

In other aspect, a driving device in this liquid crystal device and a driving method of this liquid crystal device are respectively defined.

In accordance with the liquid crystal device, liquid crystal driving device and method of driving the same in the respective aspects, the opposite electrode is divided every row. When the polarity of the voltage applied to the liquid crystal layer is inverted, the voltage applied to the opposite electrode in each row is changed in synchronization with timing at a selecting time of each scanning line.

BRIEF DESCRIPTION OF THE DRAWINGS

FIG. 10A is a view showing a driving waveform of conventional frame inversion driving, and FIG. 10B is a view showing writing polarity to each pixel, and FIG. 10C is a view for explaining a frame inversion driving system in more detail.

DESCRIPTION OF THE EMBODIMENTS

Figure 1:
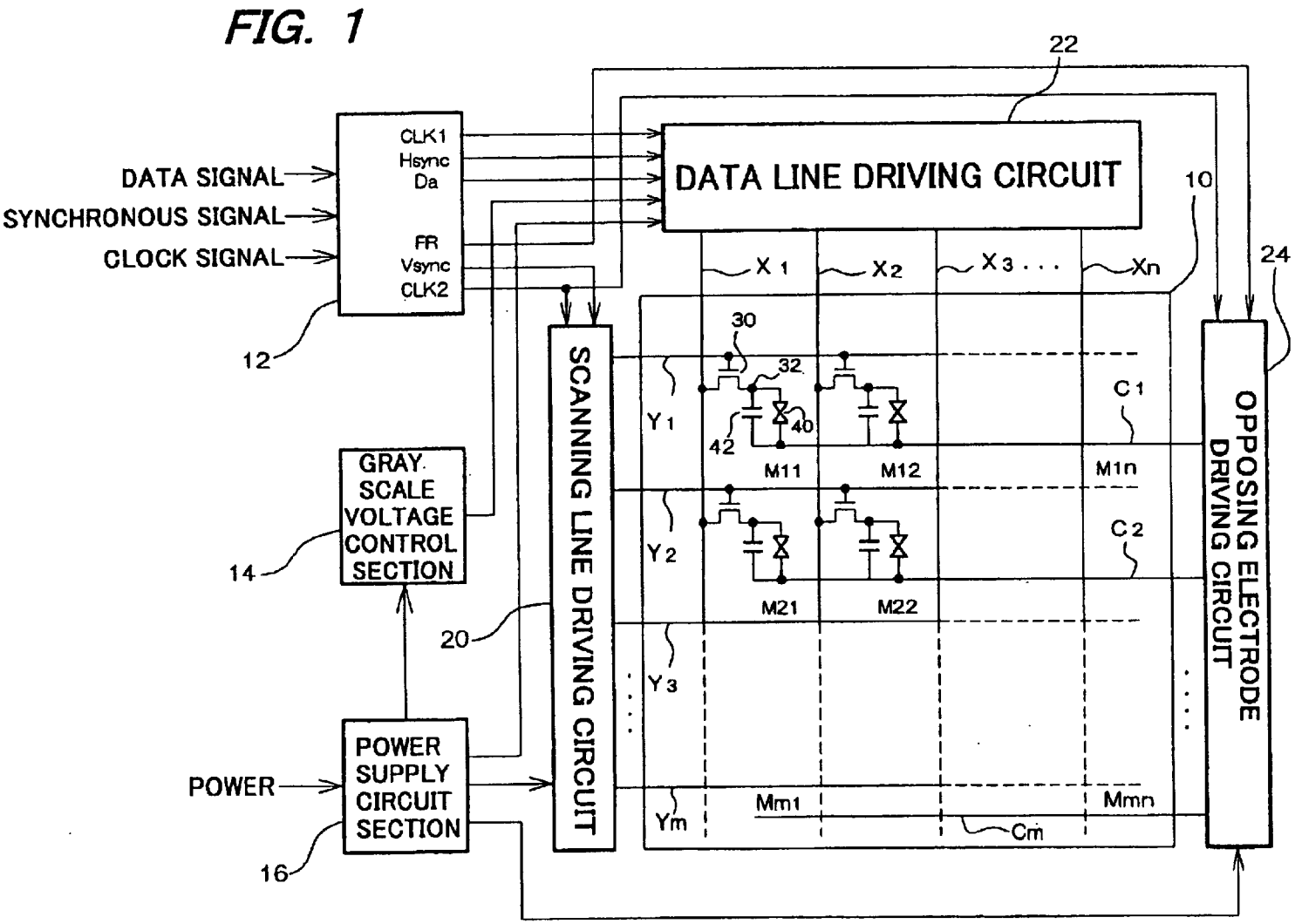
FIG. 1 is a view showing a liquid crystal device in accordance with each of first and second embodiments.

The present invention can provide a liquid crystal device, liquid crystal driving device and method of driving the same, and electronic equipment with low power consumption for solving the problem that a voltage to be applied to a liquid crystal is changed by parasitic capacity, etc. and is therefore recognized as flicker.

A liquid crystal device in one embodiment of the present invention comprises:

M (M is an integer equal to or greater than 2) rows of scanning lines, and N (N is an integer equal to or greater than 2) columns of data lines;

M×N number of switching element respectively connected to one of the M rows of scanning lines and one of the N columns of data lines;

M×N number of pixel electrodes respectively connected to one of the M×N number of switching element;

M rows of opposite electrodes arranged oppositely to respective rows of the M×N number of pixel electrodes through a liquid crystal layer;

scanning line driving circuit which supplies a scanning signal including a scanning period for selecting at least one of the M rows of scanning lines to the M rows of scanning lines;

data line driving circuit which supplies a data signal to the N columns of data lines; and polarity inverting circuit which inverts a polarity of a voltage applied to the liquid crystal layer by changing a voltage supplied to an opposite electrode of a row corresponding to the selected scanning line in synchronization with the scanning period.

In other embodiments, a driving device within this liquid crystal device and a driving method of this liquid crystal device are respectively defined.

In accordance with the liquid crystal device, liquid crystal driving device and method of driving the same in the respective embodiments, the opposite electrode is first divided every row. When the polarity of the voltage applied to the liquid crystal layer is inverted, the voltage applied to the opposite electrode in each row is changed in synchronization with timing at a selecting time of each scanning line. Thus, it is possible to restrain flicker due to the influence of parasitic capacity accumulated within a switching element and wiring. Further, frequency of the voltage applied to the opposite electrode can be reduced, and power consumption can be reduced.

The polarity inverting circuit may invert a voltage supplied to the opposite electrodes for the respective rows in synchronization with a beginning of the scanning period. This is because the voltage supplied to the opposite electrode can be changed in synchronization with a change in the data signal.

The polarity inverting circuit may comprise: a memory section which holds a first electric potential or a second electric potential as an electric potential for each of the M rows of opposite electrodes, and updates the held electric potential every scanning period; and an electric potential selecting circuit for selecting the electric potential supplied to the M rows of opposite electrodes based on the first electric potential or the second electric potential outputted from the memory section every scanning period.

In accordance with such a construction, the polarity inverting circuit can be operated in synchronization with the scanning period for selecting the scanning line.

The memory section may be a shift register which sequentially shifts an input signal of the first electric potential or the second electric potential. When the shift register is used, frame inversion driving for inverting the polarity of the voltage applied to the liquid crystal layer every frame can be easily embodied. This embodiment of the present invention is not limited to use of the frame inversion driving, but can be also applied to line inversion driving.

The M rows of opposite electrodes may be formed by M number of rectangular electrodes formed along each of the M rows of scanning lines, and the M number of rectangular electrodes may be insulated from each other.

In accordance with such a construction, only an opposite electrode corresponding to the selected scanning line is selected, and the polarity of the voltage applied to the liquid crystal layer can be inverted by the polarity inverting circuit.

Further, a substrate in another embodiment has M rows of opposite electrodes.

The substrate having such a construction is used together with an active matrix substrate of the liquid crystal device in accordance with one embodiment of the present invention as a pair so that the voltage supplied from the opposite electrode driving circuit every scanning line can be easily controlled.

The embodiments of the present invention will next be explained in further detail with reference to the drawings.

First Embodiment

FIG. 1 shows a block diagram of a liquid crystal device in the invention.

Figure 9:
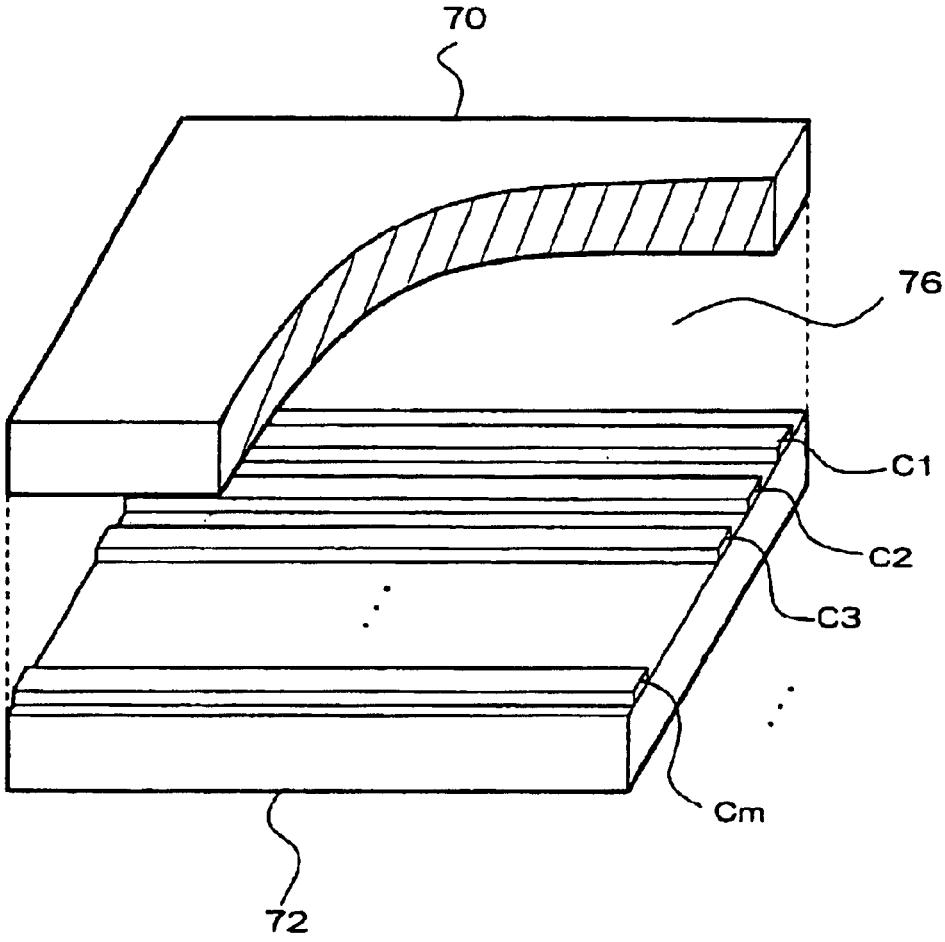
FIG. 9 is a view of an opposite substrate in which an opposite electrode utilized in the present invention is arranged in a rectangular shape.
Figure 11A:
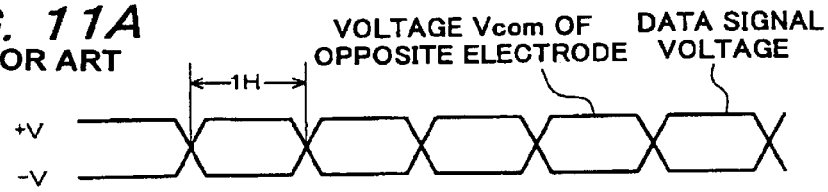
FIG. 11A PRIOR ART
FIG. 11A is a view showing a driving waveform of conventional line inversion driving.
Figure 11B:
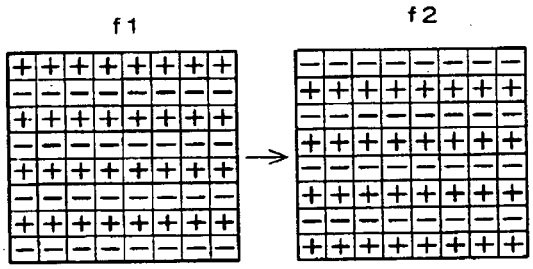
FIG. 11B PRIOR ART
FIG. 11B is a view showing writing polarity to each pixel.
Figure 11C:
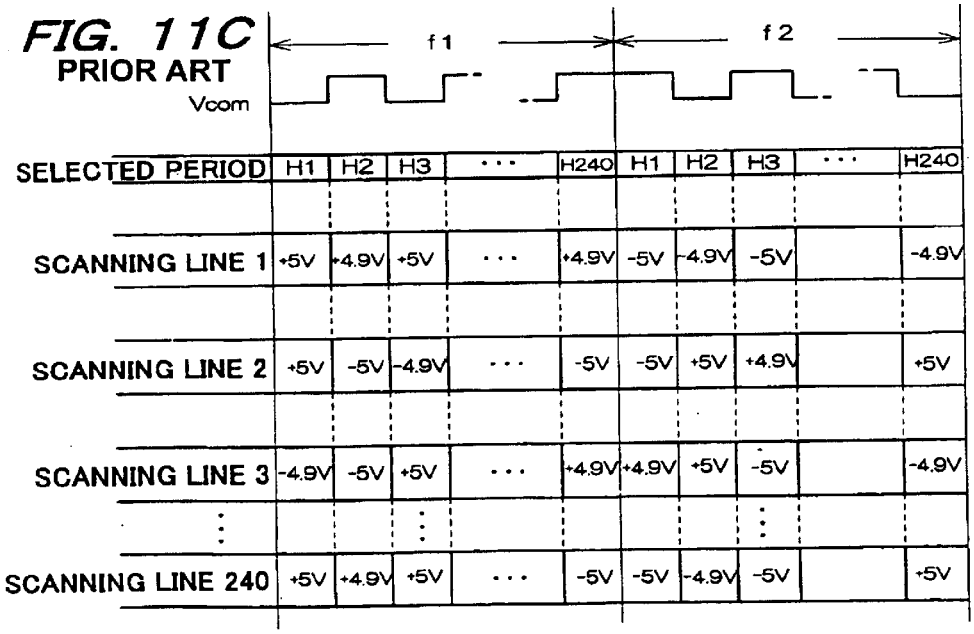
FIG. 11C PRIOR ART
FIG. 11C is a view for explaining a line inversion driving system in more detail.
Figure 12:
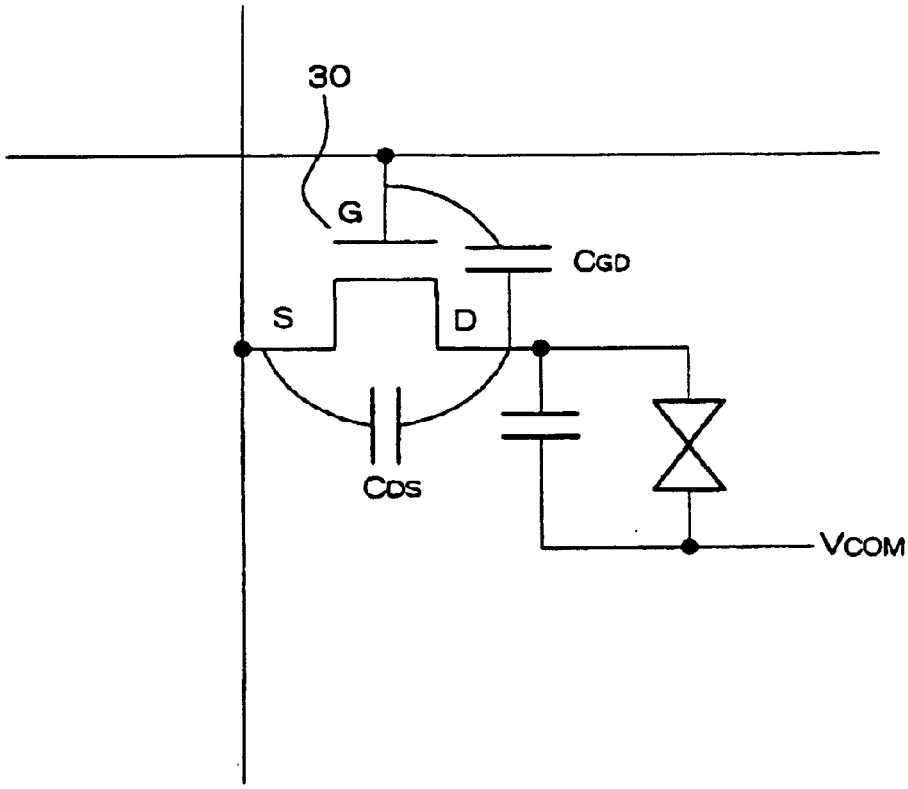
FIG. 12 is a view for explaining the parasitic capacity of a TFT.

This liquid crystal device is constructed by a liquid crystal panel 10, a signal control circuit section 12, a gray scale voltage circuit section 14, a power supply circuit section 16, a scanning line driving circuit 20, a data line driving circuit 22 and an opposing electrode driving circuit 24. In FIG. 1, pixels formed in the liquid crystal panel 10 are defined as M11 to Mmn (m and n are integers equal to or greater than 2). Here, a scanning line is shown by Y, and a data line is shown by X. When only a certain specific scanning line or data line is designated, this specific scanning line or data line is denoted as $Y_1$, $Y_2$, - - - , Ym, or $X_1$, $X_2$, - - - , Xn. An opposite electrode is shown by C. This opposite electrode C is formed in a rectangular shape so as to correspond to the scanning line, and rectangular electrodes $C_1$ to Cm are respectively insulated from each other. This opposite electrode C is shown in FIG. 9. In FIG. 9, the opposite electrodes $C_1$ to Cm are arranged on a substrate 72. An active matrix substrate 70 is arranged on a side opposed to this substrate 72 through a liquid crystal layer 76. At least a device required for liquid crystal display as shown by the interior of the liquid crystal panel 10 is arranged in this active matrix substrate 70.

For example, the liquid crystal panel 10 is constructed by (m×n) (e.g., 2·m·240, 2·n·300 in this embodiment) pixels. A data line $X_1$ is connected to a source S of a TFT 30, and a scanning line $Y_1$ is connected to a gate G of the TFT 30 in a certain one pixel M11 within the liquid crystal panel 10. Data lines $X_1$ to Xn are operated by the data line driving circuit 22, and scanning lines $Y_1$ to Ym are operated by the scanning line driving circuit 20. A pixel electrode 32 is arranged in a drain D of the TFT 30. One end of a pixel capacitor 40 charged with a voltage applied to the liquid crystal layer, and one end of a holding capacitor 42 for holding data are connected to this pixel electrode 32. Each of the other ends of the pixel capacitor 40 and the holding capacitor 42 is connected to the opposite electrode $C_1$.

(m×n) pixels each having the same construction as the pixel M11 as mentioned above are formed within the liquid crystal panel 10.

Power, a data signal, a synchronous signal and clock signals CLK1, CLK2 are supplied from the exterior to the liquid crystal device of FIG. 1.

The signal control circuit section 12 supplies the clock signal CLK1, a data signal Da and a horizontal synchronous signal Hsync to the data line driving circuit 22. For example, the data signal Da is a digital signal for showing coloring of about 16 million 770 thousand colors by each of RGB signals of 8 bits. The data line driving circuit 22 latches the data signal Da in timing of the clock signal CLK1. The horizontal synchronous signal Hsync is supplied to the data line driving circuit 22 in synchronization with the latch of the data signal Da on one line. The latched data signal Da on one line is converted to an analog signal based on this horizontal synchronous signal Hsync and a reference voltage from the gray scale voltage circuit section 14. Next, the data signal Da is next impedance-converted and supplied to the data line X.

The signal control circuit section 12 supplies the clock signal CLK2 and a vertical synchronous signal Vsync to the scanning line driving circuit 20. The scanning line driving circuit 20 sequentially switches a selected scanning line Y in timing of the clock signal CLK2. In a selected period in which a certain specific scanning line Y is selected, a scanning signal voltage for turning-on the gate of the TFT 30 connected to the scanning line is applied. A signal including this scanning signal voltage is defined as a scanning signal S. This scanning signal S is also sequentially defined as $S_1$, $S_2$, - - - , $S_{240}$ from a scanning signal supplied at the beginning of a frame period. A data signal voltage Vd outputted from the data line driving circuit 22 is supplied to the data line X in synchronization with this scanning signal S. After one frame period in which all the scanning lines X are scanned, the vertical synchronous signal Vsync is supplied to the scanning line driving circuit 20, and the scanning line Y is again scanned from the head.

As described later, the signal control circuit section 12 supplies the clock signal CLK2 and a polarity inverted signal FR to the opposite electrode driving circuit 24.

The power supply circuit section 16 supplies power to the gray scale voltage circuit section 14, the scanning line driving circuit 20, the data line driving circuit 22 and the opposite electrode driving circuit 24. For example, the opposite electrode driving circuit 24 supplies two kinds of voltages, e.g., voltages of positive and negative polarities to the opposite electrode C based on this supplied power.

Figure 2:
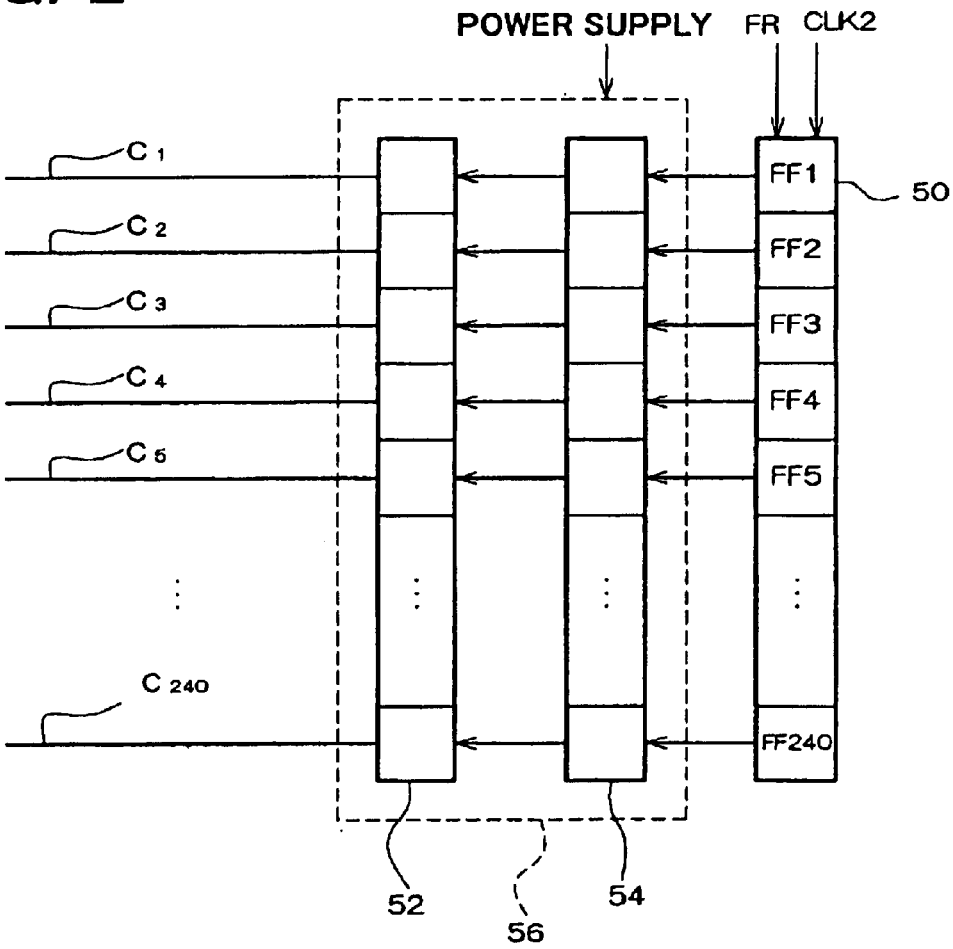
FIG. 2 is a block diagram for showing one example of the construction of an opposite electrode driving circuit of the liquid crystal device of FIG. 1.

For example, as shown in FIG. 2, the opposite electrode driving circuit 24 is constructed by a memory section, e.g., a shift register 50 and an electric potential selecting circuit 56. The electric potential selecting circuit 56 is constructed by a level shifter 54 and a driver 52.

For example, the shift register 50 is constructed by 240 delay type flip flops (FF1 to FF240) connected in series. Information stored to the shift register 50 is shifted every time the clock signal CLK2 is inputted. The information stored to the shift register 50 is converted to an analog signal by the level shifter 54, and is amplified by the driver 52 until a predetermined required voltage level, and is supplied to the opposite electrode C.

Figure 3:
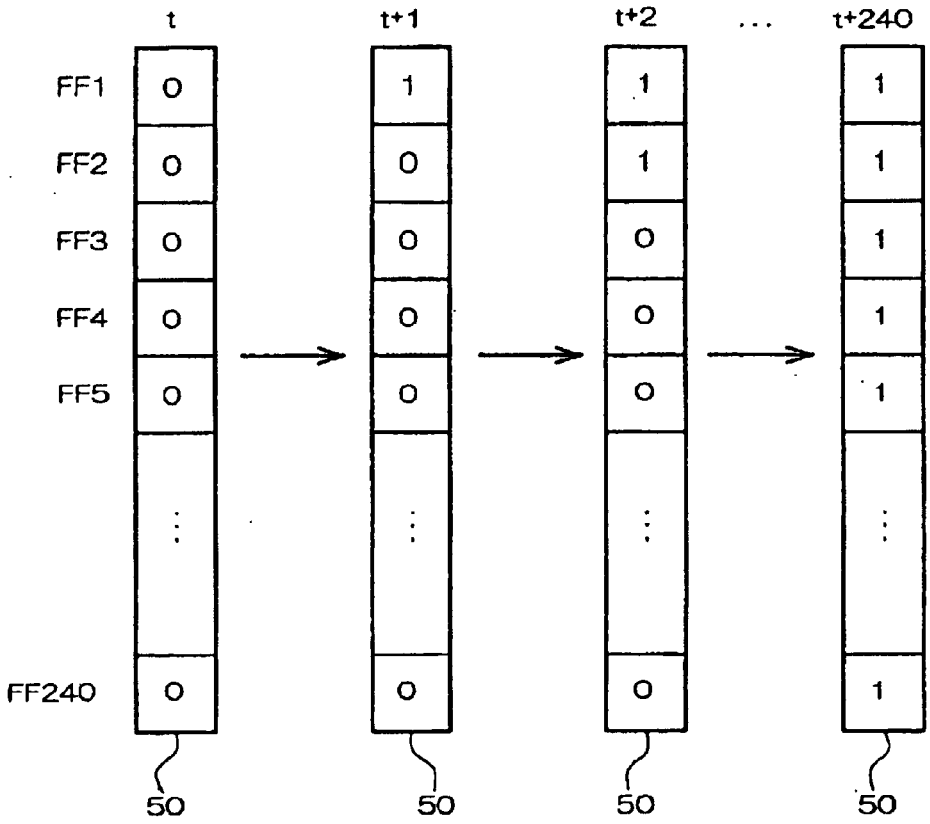
FIG. 3 is a view for explaining an operation of the opposite electrode driving circuit of FIG. 2.

FIG. 3 shows a change t to (t+240) with the passage of time when the clock signal CLK2 is inputted to the shift register 50. In FIG. 3, the voltage of negative polarity is supplied from the opposite electrode driving circuit 24 to each of the opposite electrodes $C_1$ to $C_{240}$ in the case of "0", and the voltage of positive polarity is supplied from the opposite electrode driving circuit 24 to each of the opposite electrodes $C_1$ to $C_{240}$ in the case of "1". This input signal of "0" or "1" is determined by the polarity inverted signal FR. For example, the signal of "0" or "1" is supplied to the opposite electrode driving circuit 24 every frame period in the frame inversion driving system. In the line inversion driving system, the signal of "0" or "1" is supplied to the opposite electrode driving circuit 24 every frame period and every selected period.

The operation of the opposite electrode driving circuit 24 will next be explained in the case of the frame inversion driving system.

At a time t, "0" is inputted to the flip flops FF1 to FF240, and the voltage of negative polarity is supplied to the 240 opposite electrodes $C_1$ to $C_{240}$. At a time (t+1), "1" is inputted to the flip flop FF1, and "0" is inputted to the other flip flops FF2 to FF240. The voltage of positive polarity is supplied to only the opposite electrode $C_1$ connected to this flip flop FF1. Similarly, at a time (t+2), the voltage of positive polarity is supplied to the opposite electrode $C_1$ connected to the flip flop FF1 and the opposite electrode $C_2$ connected to the flip flop FF2. Similarly, "1", is shifted, and the voltage of positive polarity is supplied to the opposite electrodes $C_1$ to $C_{240}$ respectively connected to the flip flops FF1 to FF240 at a time (t+240).

Figure 4:
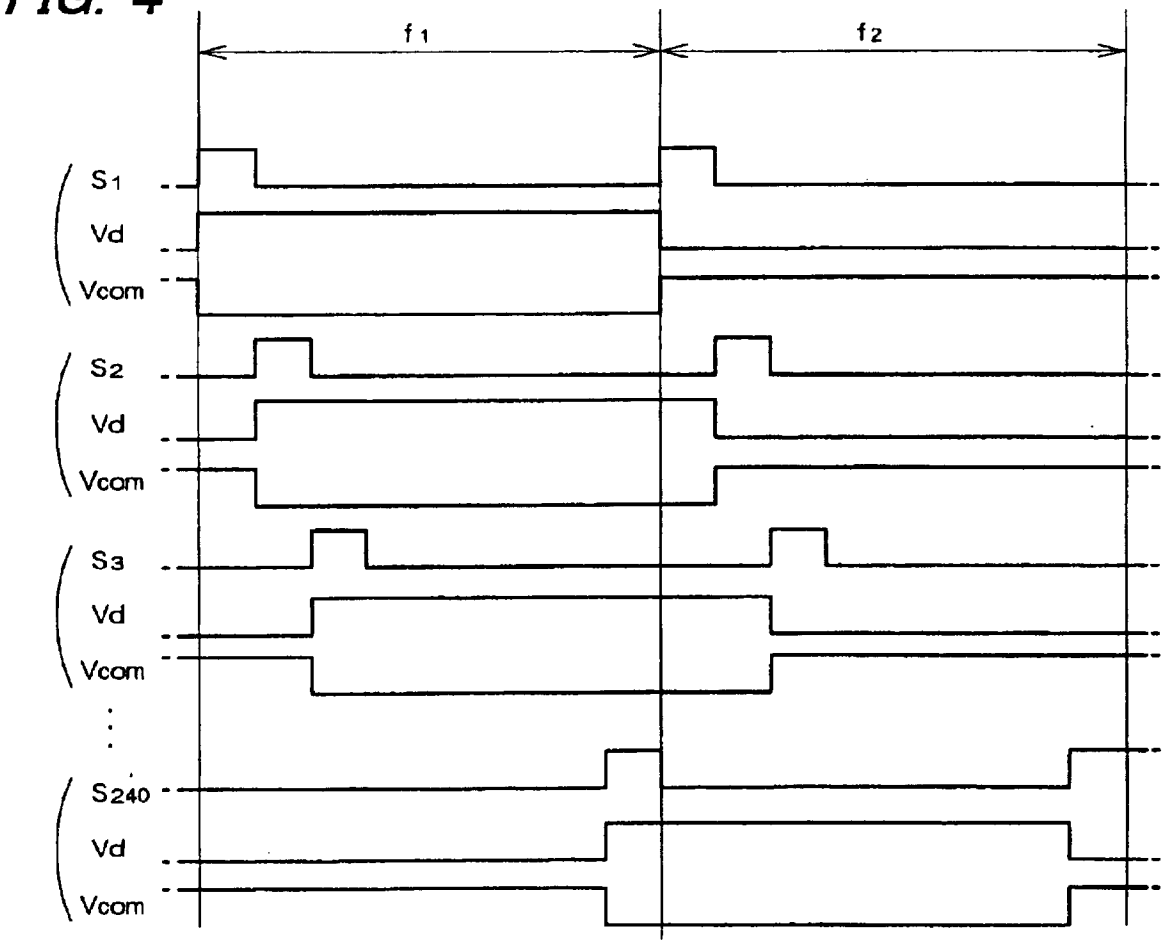
FIG. 4 is a timing chart showing an operation of the liquid crystal device in accordance with the first embodiment.

The timing chart of FIG. 4 will next be explained by using the liquid crystal device of FIG. 1. FIG. 4 shows a view in which the invention is applied to the frame inversion driving system in which the polarity of a voltage applied to the liquid crystal layer is changed every frame period. An operation shown in FIG. 3 corresponds to a frame period f2 of FIG. 4.

A scanning line $Y_1$ is selected and a data signal voltage +Vd of positive polarity is supplied to each of data lines $X_1$ to Xn by a scanning signal $S_1$ supplied at the beginning of a frame period $f_1$. Accordingly, the voltage +Vd of positive polarity is supplied from the data lines $X_1$ to Xn to each pixel electrode 32. A voltage −Vcom of negative polarity is supplied from the opposite electrode driving circuit 24 in synchronization with this scanning signal $S_1$ based on the clock signal CLK2.

Next, a scanning line $Y_2$ is selected and a data signal voltage +Vd of positive polarity is supplied to each of data lines $X_1$ to Xn by a scanning signal $S_2$. Accordingly, the voltage +Vd of positive polarity is supplied from the data lines $X_1$ to Xn to each pixel electrode 32. In this case, timing of the voltage −Vcom of negative polarity supplied from the opposite electrode driving circuit 24 is synchronized with the scanning signal $S_2$.

Similarly, when a scanning line $Y_3$ is selected by a scanning signal $S_3$, a data signal voltage +Vd of positive polarity is supplied to each of the data lines $X_1$ to Xn. Accordingly, the voltage +Vd of positive polarity is supplied to each pixel electrode 32 through the data lines $X_1$ to Xn. In this case, timing of the voltage −Vcom of negative polarity supplied from the opposite electrode driving circuit 24 is synchronized with the scanning signal $S_3$.

Similarly, timing of the voltage −Vcom of negative polarity supplied from the opposite electrode driving circuit 24 is synchronized with a scanning signal S. In a subsequent frame period $f_2$, timing of a voltage +Vcom of positive polarity supplied from the opposite electrode driving circuit 24 is similarly synchronized with the scanning signal S.

Thus, in this embodiment, when the polarity of a voltage applied to the liquid crystal layer is inverted, the voltage applied to the opposite electrode is changed in synchronization with timing at a selecting time of each scanning line. Accordingly, when the polarity of the voltage applied to the opposite electrode is inverted in synchronization with the beginning of the frame period, it is possible to prevent a voltage caused by parasitic capacity from being applied to the liquid crystal layer so that flicker appearing in a liquid crystal panel can be restrained.

Second Embodiment

Figure 5:
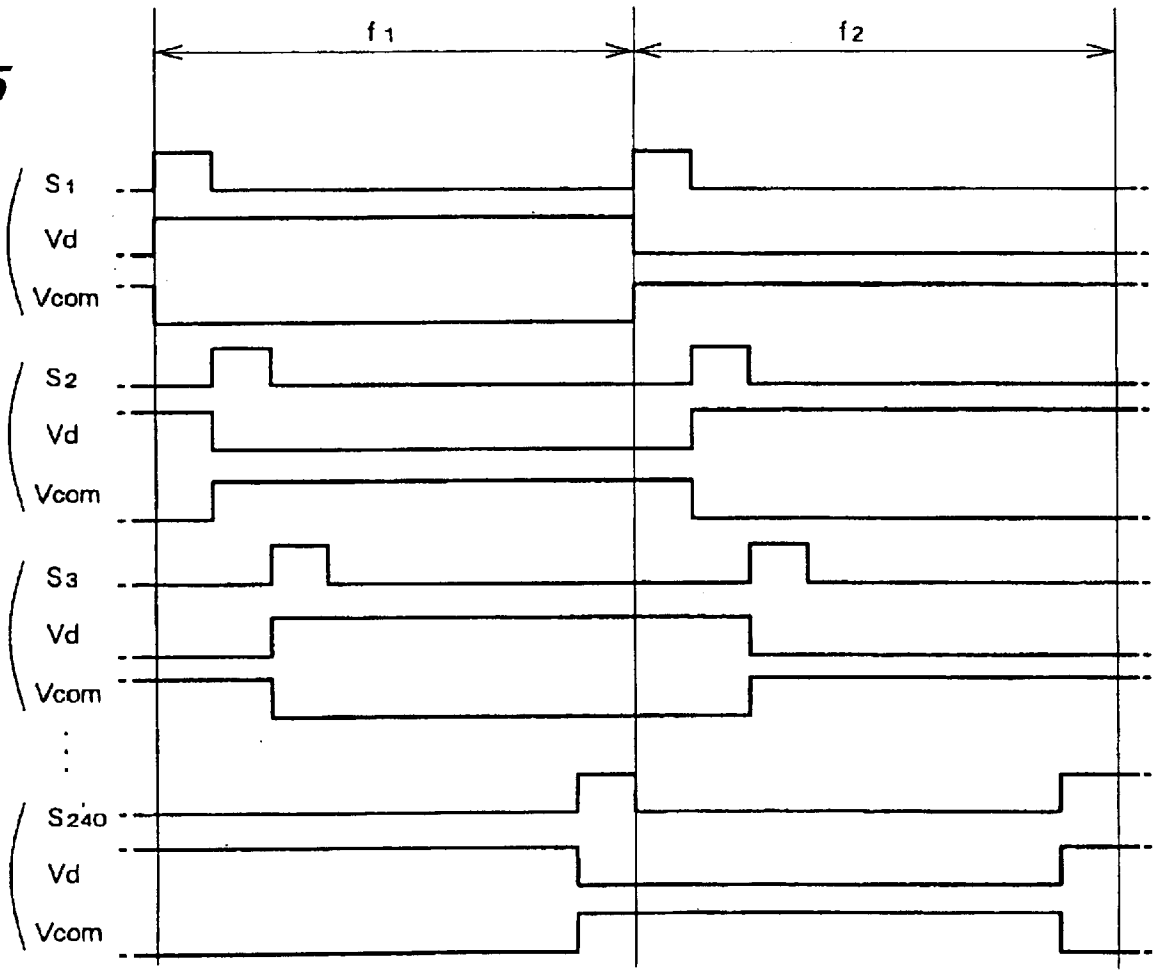
FIG. 5 is a timing chart showing an operation of the liquid crystal device in accordance with the second embodiment.

The timing chart of FIG. 5 will be explained by using the liquid crystal device of FIG. 1. FIG. 5 shows a view in which the invention is applied to a line inversion driving system for changing the polarity of the voltage applied to the liquid crystal layer every frame and every scanning line.

A scanning line $Y_1$ is selected and a data signal voltage +Vd of positive polarity is supplied to each of data lines $X_1$ to Xn by a scanning signal $S_1$ supplied at the beginning of a frame period $f_1$. Accordingly, the voltage +Vd of positive polarity is supplied to each pixel electrode 32 through the data lines $X_1$ to Xn. A voltage −Vcom of negative polarity is supplied from the opposite electrode driving circuit 24 in synchronization with this scanning signal $S_1$.

Next, a scanning line $Y_2$ is selected and a data signal voltage −Vd of negative polarity is supplied to each of data lines $X_1$ to Xn by a scanning signal $S_2$. Accordingly, the voltage −Vd of negative polarity is supplied from the data lines $X_1$ to Xn to each pixel electrode 32. In this case, timing of a voltage +Vcom of positive polarity supplied from the opposite electrode driving circuit 24 is synchronized with the scanning signal $S_2$.

Similarly, when a scanning signal $Y_3$ is selected by a scanning signal $S_3$, a data signal voltage +Vd of positive polarity is supplied to each of the data lines $X_1$ to Xn. Accordingly, the voltage +Vd of positive polarity is supplied from the data lines $X_1$ to Xn to each pixel electrode 32. In this case, timing of a voltage −Vcom of negative polarity supplied from the opposite electrode driving circuit 24 is synchronized with the scanning signal $S_3$.

Similarly, the voltage −Vcom of negative polarity or the voltage +Vcom of positive polarity alternately supplied from the opposite electrode driving circuit 24 is synchronized with timing of the scanning signal S.

In a frame period $f_2$, the voltage −Vcom of negative polarity or the voltage +Vcom of positive polarity alternately supplied from the opposite electrode driving circuit 24 is similarly synchronized with the scanning signal S.

In this embodiment, when the polarity of the voltage supplied to the liquid crystal layer is inverted, the voltage applied to the opposite electrode is changed in synchronization with timing at a selecting time of each scanning line. Thus, it is possible to restrain a change in voltage applied to a pixel due to the influence of parasitic capacity accumulated within the TFT 30 and wiring. Further, in this embodiment, it is sufficient to invert the voltage polarity of only the opposite electrode C corresponding to each scanning line Y in a frame period instead of every selected period. Thus, in comparison with the conventional line inversion driving system, frequency in driving the opposite electrode by the opposite electrode driving circuit 24 can be restrained so that power consumption can be reduced.

Third Embodiment

Figure 6:
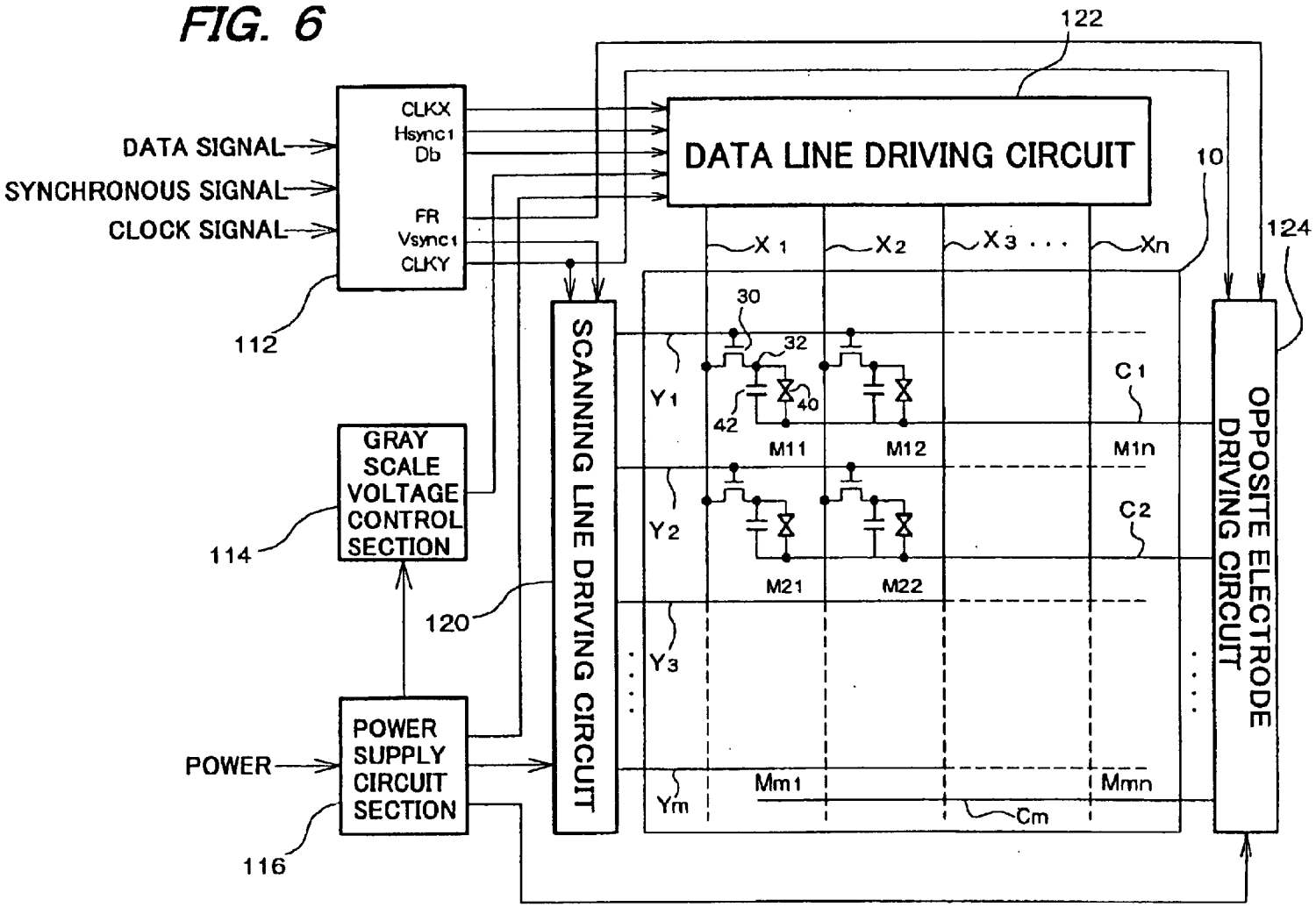
FIG. 6 is a view showing a liquid crystal device in accordance with a third embodiment.

FIG. 6 shows a liquid crystal device in a third embodiment of the invention.

A data signal, a synchronous signal and a clock signal are supplied to a signal control circuit section 112. The signal control circuit section 112 supplies a clock signal CLKX, a horizontal synchronous signal Hsync1 and a data signal Db to a data line driving circuit 122. The signal control circuit section 112 supplies a clock signal CLKY and a vertical synchronous signal Vsync1 to a scanning line driving circuit 120. The signal control circuit section 112 also supplies a polarity inverted signal FR and the clock signal CLKY to an opposite electrode driving circuit 124.

Similar to the gray scale voltage circuit section 14, a gray scale voltage circuit section 114 supplies a voltage as a reference to the data line driving circuit 122. Similar to the power supply circuit section 16, a power supply circuit section 116 supplies power to each device for operating the liquid crystal device.

Here, the vertical synchronous signal Vsync1 is a signal for determining each subfield defined by dividing one field (one frame). A signal inverted in level is supplied by the polarity inverted signal FR to the opposite electrode driving circuit 124 every one subfield. The clock signal CLKY is a signal for prescribing a horizontal scanning period S. The horizontal synchronous signal Hsync1 is a signal outputted by the clock signal CLKX after each RGB data signal Db on one line is latched to the data line driving circuit 122. A counter for counting the vertical synchronous signal Vsync1 is arranged in the signal control circuit section 112 although this counter is not illustrated. A signal supplied as the polarity inverted signal FR is determined based on results of this counter.

Here, a concept of the subfield will next be explained.

Figure 7:
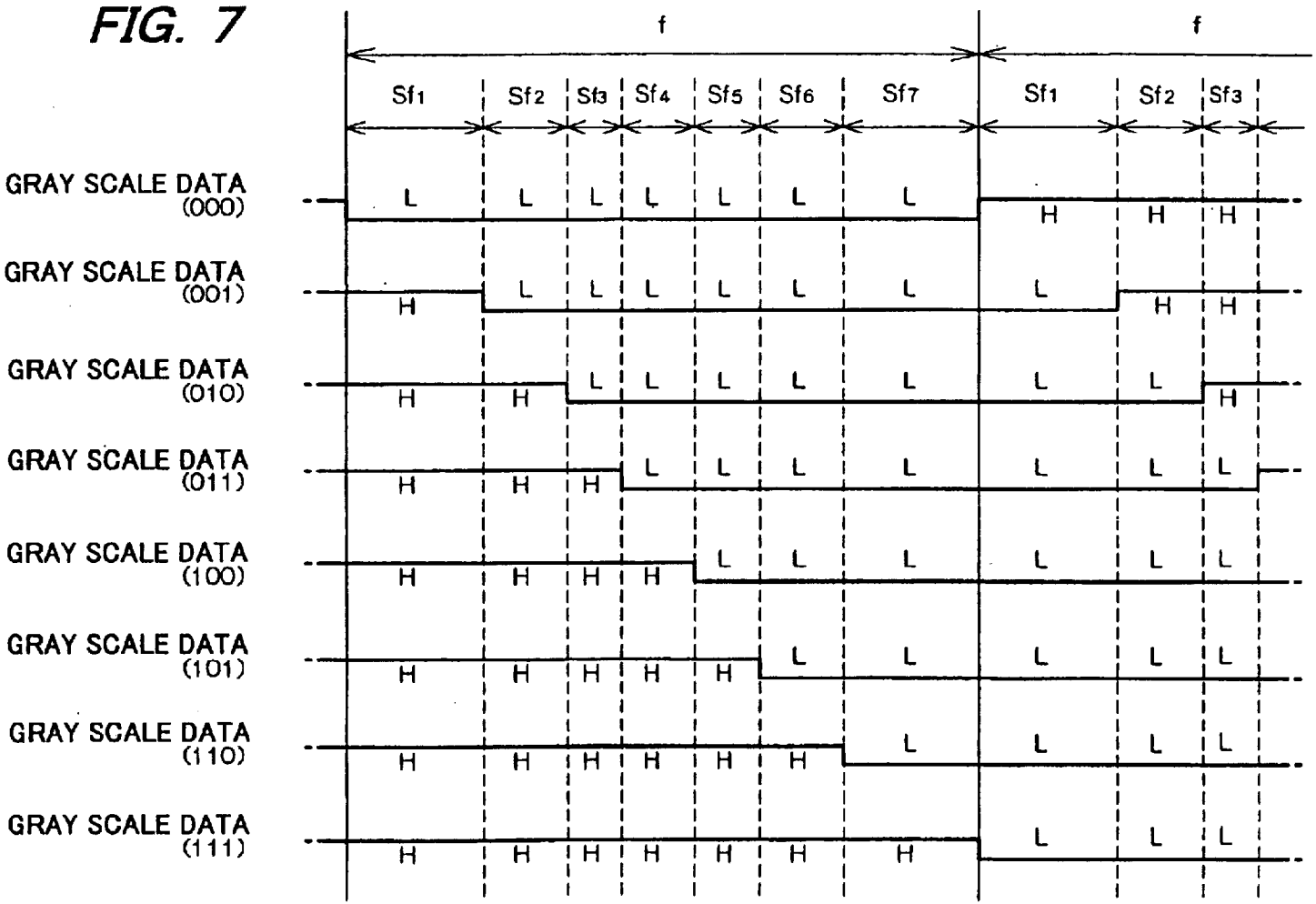
FIG. 7 is a view showing one example of a data signal Ds generated in a signal control circuit section of the liquid crystal device of FIG. 6.

In this embodiment, for example, the liquid crystal device shown in FIG. 7 is set to be able to perform eight gray scales display. Namely, the data signal Db is constructed by three bits in each of RGB. In such a liquid crystal device in this embodiment, the voltage applied to the liquid crystal layer is set to e.g., only two values of voltages V0 (=0 V) and V7. In the case of a normally white liquid crystal panel, transmittance is 0% when the voltage V0 is applied to the liquid crystal layer in all periods of one field, and transmittance is 100% when the voltage V7 is applied to the liquid crystal layer. Further, the gray scale display corresponding to each of predetermined required voltages V1 to V6 applied to the liquid crystal layer can be performed by controlling a ratio of a period for applying the voltage V0 to the liquid crystal layer and a period for applying the voltage V7 to the liquid crystal layer with respect to one field. Therefore, one field f is divided into seven periods to partition the period for applying the voltage V0 to the liquid crystal layer and the period for applying the voltage V7 to the liquid crystal layer. These divided periods are defined as subfields $Sf_1$ to $Sf_7$.

For example, when gray scale data are (001) (when the gray scale display having 14.3% in transmittance of a pixel is performed) and the voltage of the opposite electrode C is 0 V, the voltage V7 is applied to a selected pixel in the subfield $Sf_1$. In contrast to this, the voltage V0 is applied to the other subfields $Sf_2$ to $Sf_7$. Here, a voltage effective value is calculated by an averaged square root of the second power of a voltage instant value over one period (one field). Namely, when the subfield $Sf_1$ is set so as to be $(V1/V7)^2$ with respect to one field f, the voltage effective value applied to the liquid crystal layer within one field f becomes V1.

Thus, periods of the subfields $Sf_1$ to $Sf_7$ are set and a voltage according to the gray scale data is applied to the liquid crystal layer so that the gray scale display with respect to each transmittance can be performed although only binary voltages V1 and V7 are supplied to the liquid crystal layer.

The signal control circuit section 112 converts the supplied data signal of three bits in each of RGB to a binary signal Ds every subfields $Sf_1$ to $Sf_7$. This binary signal Ds is supplied to the data line driving circuit 122, and one of the voltages V0 and V7 is applied to the liquid crystal layer as a data signal voltage Vd.

FIG. 7 shows a voltage waveform of gray scale data (000) to (111) applied to the liquid crystal layer. The voltage V7 ("H") or the voltage V0 ("L") is applied to the liquid crystal layer in each period of the subfields $Sf_1$ to $Sf_7$ in accordance with each gray scale data. For example, in the case of gray scale data (001), (HLLLLLL) is applied to the liquid crystal layer in an order of the subfields $Sf_1$ to $Sf_7$.

Figure 8:
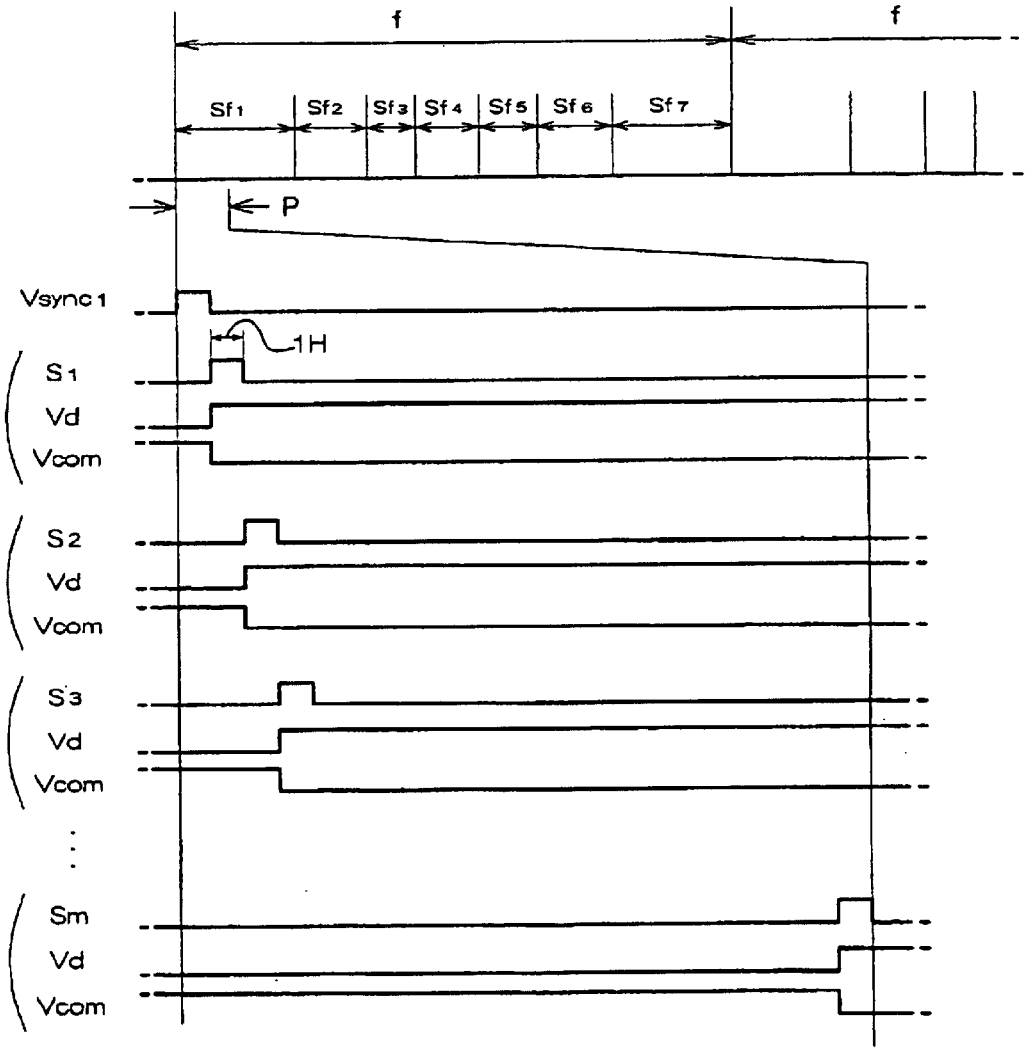
FIG. 8 is a timing chart showing an operation of the liquid crystal device of FIG. 6.

FIG. 8 is a timing chart showing an operation of the liquid crystal device of FIG. 6.

In each subfield, a period p for supplying scanning signals $S_1$ to Sm is set to be shorter than that in a subfield $Sf_3$ set as a shortest subfield period.

In the subfield $Sf_1$, a data signal voltage Vd is supplied in the scanning period $S_1$. A voltage Vcom of polarity reverse to that of the data signal voltage Vd is supplied from the opposite electrode driving circuit 124 to an opposite electrode $C_1$ in synchronization of the supply of the data signal voltage Vd. Similarly, the data signal voltage Vd is supplied in the scanning period Sm, and a voltage Vcom of polarity reverse to that of the data signal voltage Vd is supplied from the opposite electrode driving circuit 124 to an opposite electrode Cm in synchronization with the supply of the data signal voltage Vd.

Thus, when the liquid crystal device is operated, it is possible to restrain a change in the voltage applied to the liquid crystal layer due to parasitic capacity, etc. caused when the polarity of the opposite electrode C is inverted by the polarity inverted signal FR in synchronization with the beginning of a frame period.

Further, when the line inversion driving is conventionally performed, the frame period f is divided into a plurality of subfields so that frequency for operating the opposite electrode driving circuit 124 is increased in proportional to frequency for inverting the polarity of the voltage of the opposite electrode. However, in this embodiment, the opposite electrode C is constructed as shown in FIG. 9. Accordingly, it is possible to operate each opposite electrode only when a corresponding scanning line is selected. Therefore, frequency in operating the opposite electrode by the opposite electrode driving circuit 124 can be restrained, and power consumption can be reduced.

In the embodiment, the scanning line Y is selected one by one. However, when a plurality of scanning lines are selected and operated, similar effects are obtained by operating the opposite electrode on each line corresponding to a selected scanning line in synchronization with a selected period of the scanning line.

The invention is not limited to the embodiment, but can be variously modified and embodied within the scope of features of the invention. For example, the invention is not limited to driving of the liquid crystal device of the TFT type, but can be also applied to an image display unit using a plasma display unit.

The invention can be applied to any electronic equipment having the liquid crystal device. For example, the invention can be applied to various kinds of electronic equipment such as a portable telephone, a game machine, an electronic note, a personal computer, a word processor, a television and a car navigation device.

What is claimed is:

1. A liquid crystal device, comprising:

M rows of scanning lines, wherein M is an integer equal to or greater than 2, and N columns of data lines, wherein N is an integer equal to or greater than 2;

M×N number of switching element respectively connected to one of the M rows of scanning lines and one of the N columns of data lines;

M×N number of pixel electrodes respectively connected to one of the M×N number of switching element;

M rows of opposite electrodes arranged oppositely to respective rows of the M×N number of pixel electrodes through a liquid crystal layer;

a scanning line driving circuit configured to supply a scanning signal including a scanning period for sequentially selecting at least one of the M rows of scanning lines to the entire M rows of scanning lines in each of a plurality of subfields defined by dividing one field;

a signal control circuit configured to convert a data signal to a binary signal in each of the subfields;

a data line driving circuit configured to supply a binary voltage to the N columns of data lines based on the binary signal from the signal control circuit; and a polarity inverting circuit configured to invert a polarity of a voltage applied to the liquid crystal layer in synchronization with the scanning period by changing a voltage supplied to an opposite electrode of a row corresponding to the selected scanning line in each of the subfields.

2. The liquid crystal device according to claim 1, wherein the polarity inverting circuit inverts a voltage supplied to the opposite electrodes for the respective rows in synchronization with a beginning of the scanning period.

3. The liquid crystal device according to claim 1, wherein the polarity inverting circuit comprises:

a memory section which holds a first electric potential or a second electric potential as an electric potential for each of the M rows of opposite electrodes, and updates the held electric potential every scanning period; and an electric potential selecting circuit for selecting the electric potential supplied to the M rows of opposite electrodes based on the first electric potential or the second electric potential outputted from the memory section every scanning period.

4. The liquid crystal device according to claim 3, wherein the memory Section is a shift register which sequentially shifts an input signal of the first electric potential or the second electric potential.

5. The liquid crystal device according to claim 1, wherein the M rows of opposite electrodes are formed by M number of rectangular electrodes formed along each of the M rows of scanning lines, and the M number of rectangular electrodes are insulated from each other.

6. Electronic equipment comprising a liquid crystal device according to claim 1.

7. The liquid crystal device according to claim 1, further comprising, a counter configured to count a vertical synchronous signal for determining the subfields, wherein the polarity inverting circuit inverts a voltage supplied to the apposite electrodes for the respective rows based on an output from the counter.

8. A driving device for a liquid crystal display panel, the liquid crystal display panel comprising:

M rows of scanning lines, wherein M is an integer equal to or greater than 2, and N columns of data lines, wherein N is an integer equal to or greater than 2;

M×N number of switching elements, each said switching element connected to one of the M rows of scanning lines and one of the N columns of data lines;

M×N number of pixel electrodes, each said pixel electrode connected to one of the switching elements; and M rows of opposite electrodes, each said row of opposite electrodes arranged opposite one row of pixel electrodes through a liquid crystal layer, the driving device comprising:

a scanning line driving circuit operable to supply a scanning signal including a scanning period for sequentially selecting at least one of the M rows of scanning lines to the entire M rows of scanning lines in each of a plurality of sub fields defined by dividing one field;

a signal control circuit operable to convert a data signal to a binary signal in each of the subfields;

a data line driving circuit operable to supply a binary voltage to the N columns of data lines based on the binary signal from the signal control circuit; and a polarity inverting circuit operable to invert a polarity of a voltage applied to the liquid crystal layer in synchronization with the scanning period by changing a voltage supplied to an opposite electrode of a row corresponding to the selected scanning line in each of the subfields.

9. The driving device according to claim 8, wherein the polarity inverting circuit inverts a voltage supplied to the opposite electrodes for the respective rows in synchronization with a beginning of the scanning period.

10. The driving device according to claim 8, wherein the polarity inverting circuit comprises:

a memory section which holds a first electric potential or a second electric potential as an electric potential for each of the M rows of opposite electrodes, and updates the held electric potential every scanning period; and an electric potential selecting circuit for selecting the electric potential supplied to the M rows of opposite electrodes based on the first electric potential or the second electric potential outputted from the memory section every scanning period.

11. The driving device according to claim 10, wherein the memory section is a shift register which sequentially shifts an input signal of the first electric potential or the second electric potential.

12. The driving device according to claim 8, further comprising:

a counter operable to count a vertical synchronous signal for determining the subfields, wherein the polarity inverting circuit inverts a voltage supplied to the opposite electrodes for the respective rows based on an output from the counter.

13. A driving method, comprising:

supplying a scanning signal including a scanning period in which at least one of a plurality of scanning lines is sequentially selected, to the entire plurality of scanning lines by scanning line driving circuit lines in each of a plurality of subfields defined by dividing one field;

converting a data signal to a binary signal by a signal control circuit in each of the subfields;

supplying a binary voltage to a plurality of pixel electrodes based on the binary signal from the signal control circuit by data line driving circuit through N columns of data lines and a plurality of switching elements connected to the at least one selected scanning line; and by polarity inversion driving circuit, inverting a polarity of a voltage applied to the liquid crystal layer, which is formed between the pixel electrodes and the opposite electrode in synchronization with the scanning period by changing a voltage supplied to an opposite electrode of a row corresponding to the selected scanning line in each of the subfields.

14. The driving method according to claim 13, wherein the polarity inverting circuit inverts a voltage supplied to an opposite electrode of a row corresponding to the selected scanning line based on an output from a counter which counts a vertical synchronous signal for determining the subfields.

* * * * *